US009309018B2

(12) United States Patent
Busch et al.

(10) Patent No.: US 9,309,018 B2
(45) Date of Patent: Apr. 12, 2016

(54) PACKAGING FOR UV STERILIZATION

(75) Inventors: Detlef Busch, Saarlouis (DE); Dirk Walgenbach, Ottweiler (DE); Bertram Schmitz, Sarreguemines (FR)

(73) Assignee: Treofan Germany GmbH & Co. KG, Neunkirchen (DE)

( * ) Notice: Subject to any disclaimer, the term of this patent is extended or adjusted under 35 U.S.C. 154(b) by 681 days.

(21) Appl. No.: 12/531,317

(22) PCT Filed: Mar. 13, 2008

(86) PCT No.: PCT/EP2008/002008
§ 371 (c)(1),
(2), (4) Date: Sep. 15, 2009

(87) PCT Pub. No.: WO2008/113509
PCT Pub. Date: Sep. 25, 2008

(65) Prior Publication Data

US 2010/0092627 A1 Apr. 15, 2010

(30) Foreign Application Priority Data

Mar. 16, 2007 (DE) ..... 10 2007 012 623

(51) Int. Cl.
*B65B 55/16* (2006.01)

(52) U.S. Cl.
CPC ..... *B65B 55/16* (2013.01)

(58) Field of Classification Search
CPC ..... B65B 55/16
USPC ..... 422/22, 24
See application file for complete search history.

(56) References Cited

U.S. PATENT DOCUMENTS

| | | | | |
|---|---|---|---|---|
| 4,112,124 | A | 9/1978 | Jarvis | |
| 4,832,965 | A | 5/1989 | Helin | |
| 4,957,209 | A | 9/1990 | Helin | |
| 4,983,411 | A | 1/1991 | Tanaka et al. | |
| 5,208,297 | A | 5/1993 | Ford et al. | |
| 5,247,058 | A | 9/1993 | Gruber et al. | |
| 5,357,035 | A | 10/1994 | Gruber et al. | |
| 5,433,920 | A * | 7/1995 | Sizer et al. | 422/24 |
| 5,817,728 | A * | 10/1998 | Higuchi et al. | 527/300 |
| 5,914,381 | A * | 6/1999 | Terado et al. | 527/300 |
| 6,429,280 | B1 * | 8/2002 | Hiraoka et al. | 528/354 |
| 6,433,344 | B1 * | 8/2002 | Salisbury et al. | 250/455.11 |
| 7,026,379 | B2 * | 4/2006 | Oyasato et al. | 524/35 |
| 2003/0069354 | A1 * | 4/2003 | Oyasato et al. | 525/54.21 |
| 2004/0161622 | A1 * | 8/2004 | Rosenbaum et al. | 428/480 |
| 2004/0219056 | A1 * | 11/2004 | Tribelsky et al. | 422/22 |
| 2005/0154365 | A1 * | 7/2005 | Zander et al. | 604/385.04 |
| 2005/0165445 | A1 * | 7/2005 | Buckman et al. | 606/213 |
| 2007/0051653 | A1 * | 3/2007 | Tilton | 206/462 |

FOREIGN PATENT DOCUMENTS

| | | | |
|---|---|---|---|
| EP | 0679506 | A1 | 11/1995 |
| EP | 1619021 | A1 | 1/2006 |
| FR | 2773715 | A1 | 7/1999 |
| GB | 1460134 | | 12/1976 |
| WO | WO-8606700 | A1 | 11/1986 |
| WO | WO-9836907 | A1 | 8/1998 |

* cited by examiner

*Primary Examiner* — Regina M Yoo
(74) *Attorney, Agent, or Firm* — Drinker Biddle & Reath LLP

(57) ABSTRACT

The present invention relates to a method for the disinfection, partial disinfection or sterilization of a product by means of UV radiation. A product is enclosed with a UV permeable packaging material made of polyhydroxycarboxylic acid and subsequently disinfecting, partially disinfecting or sterilizing in the packaged state by means of irradiation with UV radiation.

19 Claims, No Drawings

PACKAGING FOR UV STERILIZATION

CROSS-REFERENCE TO RELATED APPLICATIONS

This application is a national stage application (under 35 U.S.C. §371) of PCT/EP2008/002008, filed Mar. 13, 2008, which claims benefit of German application 10 2007 012 623.0, filed Mar. 16, 2007.

BACKGROUND OF THE INVENTION

The invention relates to a packaging with foodstuffs and/or articles of daily use that are sterilized or disinfected for hygienic reasons. The invention also relates to a method for the sterilization, disinfection or partial disinfection of packaged goods.

As long as anyone can remember, sunlight has been credited with the power to counteract diseases or the spreading of infections. Later research showed that the bactericidal effect emanates from the invisible portion of the solar radiation below 320 nm. Therefore, already at the end of the 19th century, the first artificial UV radiation sources were developed and used. An effective disinfection method without chemical agents or the use of high temperatures was hence available.

In the process of the gentle production of foodstuffs and medicinal products, efficient packaging becomes more and more important. Because of changed products and consumer behavior, partially disinfected or aseptic packaging are filled with increasing frequency in order to optimally preserve the quality, prevent premature spoilage and the multiplication of disease-producing germs and hence overall extend the storage life. For the partial disinfection of packaging materials in particular, UV irradiation is a method that is used in practice. However, in many cases it is not sufficient to use disinfected packaging material since the products themselves are frequently contaminated by viruses and bacteria. For a hygienically acceptable packaging unit, the sterilization of the products is therefore necessary in addition. Nevertheless, the possibility that re-germination has occurred by the time the filling or actual packaging of the products takes place cannot be excluded. In any case, several process steps are necessary and high demands on hygiene and cleanliness have to be met when packaging and filling in order to produce a packaging unit that is as hygienically acceptable as possible.

For example, UV treatment of the wash and transport water with the help of which the foodstuffs are pre-purified takes place first. Subsequently, an additional UV treatment of the product to be packaged is required. For this, the different foodstuffs or goods pass through a section in which they are subjected to the UV radiation for a certain period of time in order to achieve a certain disinfection rate. The goal is to kill 90% of the germs residing on the surface and subsequently package the product under sterile conditions.

UV irradiation to disinfect products becomes more and more important since this method has many advantages compared to sterilization methods with peroxides or superheated steam. The methods are easy to apply, the properties of the product are not affected and the disinfection is very effective. During treatment, residues, corrosive or harmful substances are not formed, the smell and taste of the foodstuffs is not altered and the purchase and maintenance costs of the systems are low.

UVC rays have a shorter wavelength and are more energy-rich than UVA and UVB rays. They comprise the largest portion of the entire UV range and exhibit a strong germkilling (bactericidal) effect. Just like the visible wavelengths of light, UVC rays only travel in a straight line and their intensity decreases with increasing distance from the source. As a matter of principle, UVC rays do not penetrate any material, including window glass.

UVC radiation is technically produced by mercury lamps, the primary radiation of which of 254 nm is very close to the maximum of the bactericidal action. Low-pressure lamps, high-pressure lamps or medium-pressure lamps are optionally used. The efficiency of low-pressure tubes with an efficiency factor of more than 90% in the bactericidal wavelength range is unsurpassed to this day. The remaining radiation of a low-pressure tube is distributed over secondary emissions such as light (above 400 nm) and heat.

The germicidal action of UVC rays is based on the following effects. The short-wave and energy-rich UVC rays are absorbed in certain sections of the genetic material (DNA). As a result, photochemical changes occur in certain sections of the helix, for example linkage reactions of adjacent functional groups. These sections become useless for the copying process of the helix strand operating by the template principle. The necessary passing-on of information does not happen. The cell can no longer multiply.

If the number of disruptions exceeds a level specific to each species, the cell dies without multiplying. As a consequence of this principle of action, germs are not killed in the proper sense! They are, in fact, inactivated and hence are prevented from building up a critical potential by cell division.

BRIEF SUMMARY OF THE INVENTION

The invention was based on the object to provide an improved method for producing sterile, packaged products.

This object is solved by a method for disinfecting products in which the products are enclosed with a packaging material and in the packaged state are irradiated with UVC radiation, the packaging material being permeable to UVC rays.

In prior art, as yet no packaging materials are known that are sufficiently permeable to UVC rays. Hence, as yet it has never been proposed to perform the UV disinfection of the products in the packaged state.

Surprisingly, within the scope of the present invention packaging materials were found that are permeable to UVC rays, contrary to the preconception of prior art. For this reason, according to the invention it is possible to first package products and to then sterilize or disinfect them. The method according to the invention has the extraordinary advantage that the products are disinfected in their packaging or together with the packaging material by means of UVC radiation. For this reason, recontamination after disinfection of the products on the way to packaging is practically completely eliminated.

Surprisingly, within the scope of the present invention UVC permeability was found for polymers of polylactic acid.

DETAILED DESCRIPTION OF THE INVENTION

The packaging material can consist of an unstretched (cast film), a monoaxially oriented or a biaxially oriented polyhydroxycarboxylic acid film comprising one or more layers. Other suitable packaging forms are containers, bowls or similar shapes. The main component of these packaging materials is a polymer made of at least one aliphatic hydroxycarboxylic acid. The packaging material or the film generally comprises at least 70-100% by weight of polymer made of aliphatic polyhydroxycarboxylic acid, preferably PLA (polylactic acid). Embodiments of 80-99% by weight, preferably 85-95% by weight, of the mentioned polymers, each based on the weight of the packaging material, are preferred.

Single-layered or multi-layered films of polyhydroxycarboxylic acid, preferably PLA, are preferably used as packaging material. Both single-layered and multi-layered films of aliphatic polyhydroxycarboxylic acid are suitable for the invention. Multi-layered films are generally composed of a thick base layer which has the largest layer thickness and accounts for 60 to 100% of the total thickness of the film. This base layer is optionally provided with covering layer(s) on one side or both sides. In further embodiments, additional interlayers or coatings on the outer surface of the single-layered or multi-layered film are possible whereby four-layered or five-layered, coated or uncoated, films are obtained. The thickness of the covering layer is generally in a range of 0.5 to 20 μm, preferably 0.5-10 μm, most preferably 1 to 5 μm. According to the invention, the total thickness of the film is in a range of 20 to 150 μm, preferably 25 to 100 μm, most preferably 30 to 100 μm. The covering layers are the layers that form the outer layers of the film. Interlayers are disposed by nature between the base layer and the covering layers. The explanations below regarding the layers of the film apply analogously in similar manner to single-layered embodiments of the film.

The layer(s) of the film comprise(s) 70 to about 100% by weight, preferably 80 to 98% by weight, of a polymer made of at least one aliphatic hydroxycarboxylic acid, below also referred to as PHC or polyhydroxycarboxylic acid. Homopolymers or mixed polymers that are composed of polymerized units of aliphatic hydroxycarboxylic acids are meant hereby. Among the PHC suitable for the present invention are in particular polylactic acids. These are referred to as PLA (polylactic acid) below. Here as well, the term PLA means both homopolymers, which are composed only of lactic acid units, and mixed polymers, which contain predominantly lactic acid units (>50%) in combinations with other aliphatic hydroxylactic acid units.

As monomers of aliphatic polyhydroxycarboxylic acid (PHC), aliphatic mono-, di-, or trihydroxycarboxylic acids or dimeric cyclic esters thereof are particularly suitable, among which lactic acid in its D- or L-form is preferred. Such polymers are known per se in prior art and are commercially available. The production of polylactic acid is also described in prior art and occurs via catalytic ring opening polymerization of lactide (1,4-dioxane-3,6-dimethyl-2,5-dione), the dimeric cyclic ester of lactic acid; PLA is therefore often referred to as polylactide. In the following publications, the production of PLA is described—U.S. Pat. No. 5,208,297, U.S. Pat. No. 5,247,058 or U.S. Pat. No. 5,357,035.

Polylactic acids composed solely of lactic acid units are preferred. PLA homopolymers comprising 80-100% by weight of L-lactic acid units, corresponding to 0 to 20% by weight of D-lactic acid units, are particularly preferred. To reduce the crystallinity, even higher concentrations of D-lactic acid units as comonomer may also be included. Optionally, the polylactic acid can additionally comprise aliphatic polyhydroxycarboxylic acid units different from lactic acid as comonomer, for example glycolic acid units, 3-hydroxypropionic acid units, 2,2-dimethyl-3-hydroxypropionic acid units, or higher homologs of hydroxycarboxylic acids having up to 5 carbon atoms.

Lactic acid polymers (PLA) having a melting point of 110 to 170° C., preferably from 125 to 165° C., and a melt flow index (measured according to DIN 53 735 at 2.16 N load and 190° C.) of 1 to 50 g/10 min, preferably from 1 to 30 g/10 min, are preferred. The molecular weight of the PLA is in a range of at least 10,000 to 500,000 (number average), preferably 50,000 to 300,000 (number average). The glass transition temperature Tg is in a range from 40 to 100° C., preferably 40 to 80° C.

Each of the individual layers of the film comprises 70 to about 100% by weight of the polymers described above, preferably 80 to 98% by weight, and optionally additionally additives such as neutralizing agents, stabilizers, slip agents, antistatic agents and other additives, provided they do not interfere with the UVC permeability.

Advantageously, they are already added to the polymer or the polymer mixture prior to melting. Phosphorous compounds, such as phosphoric acid or phosphoric acid esters, for example are used as stabilizers. In principle, the individual layers can have the same or different composition(s) with regard to the polymer and added additives. Generally, the composition of the base layer is different from the composition of the remaining layers. In particular, additives such as antiblocking agents or slip agents are added to the covering layers. Neutralizing agents and stabilizers are generally present in all layers, each in effective quantities. However, structure and composition of the individual layers of the film can in principle vary within wide limits.

It was found that transparent embodiments without vacuoles are particularly suitable for the application according to the invention.

Optionally, the film can be coated to optimize further properties. These coatings can be based on the PHC polymers described above or should on their part be permeable to UVC rays. Typical coatings are adhesion-promoting, slip-improving or dehesive-acting layers. Optionally, these additional layers can be applied by means of in-line coating using aqueous or non-aqueous dispersions prior to transverse stretching or they can be applied off-line.

The PHC film is produced by the extrusion or coextrusion method known per se. Within the scope of this method, the melt(s) corresponding to the layers of the film are coextruded through a flat film extrusion die; the single-layered or multi-layered film thus obtained is taken off on one or more roller(s) for solidification. For oriented or biaxially oriented embodiments, the film is subsequently mono- or biaxially stretched (oriented), the stretched film is heat-set. Optionally, the films are corona-treated or flame-treated on one side or both sides on the surface layer provided for treatment.

Biaxial stretching is generally performed sequentially. Preferably, stretching occurs first in the longitudinal direction (i.e. in the machine direction=MD) and subsequently in the transverse direction (i.e. perpendicular to the machine direction=TD). This results in an orientation of the molecular chains. Stretching in the longitudinal direction preferably occurs by means of two rollers running at different speeds in accordance with the desired stretch ratio. For transverse stretching, an appropriate tenter frame is generally used. Optionally, biaxial stretching can also occur simultaneously, for example by means of LISIM® technology. Further description of the film production follows using the example of a flat film extrusion with subsequent sequential stretching.

The melt(s) are pressed through a flat film extrusion die (slot die), and the pressed out film is taken off on one or more take off rollers at a temperature of 10 to 100° C., preferably 20 to 80° C., whereupon it cools and solidifies.

The film thus obtained is then stretched longitudinal and transverse to the extrusion direction. Longitudinal stretching is preferably performed at a roller temperature of the stretching roller of 40 to 130° C., preferably 50 to 100° C., advantageously by means of two rollers running at different speeds in accordance with the desired stretch ratio, and transverse stretching is preferably performed at a temperature of 50 to 130° C., preferably 60 to 120° C., by means of an appropriate tenter frame. The longitudinal stretch ratios can be varied in the range of 1.5 to 8, preferably 1.5 to 4. The transverse stretch ratios are in the range of 3 to 10, preferably 4 to 7.

The stretching of the film is followed by the heat setting (heat treatment) thereof, the film being kept convergently for about 0.1 to 10 s at a temperature of 60 to 150° C. (convergence of up to 25%). Subsequently, the film is wound up in customary fashion by means of a winding device.

Besides the films, other forms of the packaging material can also be used. For example, containers, bowls, bottles or other forms are also suitable. These receptacles are produced from the polyhydroxycarboxylic acids described above, preferably PLA, as described above in connection with the films. If necessary, the rheological properties of the polymer have to be adapted to the respective processing method; the production of injection molded or blow molded containers requires for example a different melt flow index of the PLA as film raw material. Those skilled in the art will readily select suitable raw materials from the PLA polymers known per se.

To pack or package the products, any common packaging technology and filling process can be used, for example film wrapping on HFFS or VFFS packaging machines. After packaging of the products, the disinfection, partial disinfection or sterilization by means of UV radiation according to the invention occurs. For this, the packaged product is subjected to UV radiation, which comprises the wavelength range of 254 nm (UVC), in a suitable manner in the packaging. This UV-C radiation is technically produced by mercury lamps, for example by low-pressure lamps, optionally also by high-pressure or medium-pressure lamps. The UV lamps generally consist of a housing with a quartz glass window as exit window for the radiation and the actual mercury discharge lamp. Low-pressure tubes are preferred since they are very effective with a very high efficiency factor of more than 80% in the bactericidal wavelength range of about 254 nm. Typically, these lamps also emit radiation at other wavelengths, for example in the range of 200 to 280 nm, but they have the highest intensity in the relevant range of about 254 nm. Advantageously, high-powered mercury low-pressure radiators, which are provided with a cooling device, are used. The cooling prevents heating-up and the shift of the spectrum associated therewith. These lamps are characterized by a very high and constant power output. In principle, the radiant power of the UV lamps used can vary within a broad range, for example between 50 and 250 W, preferably between 100 and 150 W. The power supply, control and monitoring of the operating parameters can occur via a ballast. The intensity of the irradiation can be individually tuned to the respective sterilization or disinfection process, or the goods to be filled. The intensity of the irradiation specifies the radiant power per surface area and is for example 10 to 200 mW/cm$^2$, preferably 50 to 150 mW/cm$^2$. To irradiate the packaged goods, they run through the UV section, moved by a conveyor system, for example by means of a conveyor belt that is passed under the UV lamp. The irradiation time and hence the radiation dosage can be regulated via the speed of the belt. Optionally, with constant web speed dosing can also occur via appropriate filters that affect the transmission of the produced UV radiation. For optimum disinfection of the products, all three parameters should be adjusted and optimized with regard to the best efficiency possible. The radiation dosage in particular can be adjusted via both the irradiation time and the intensity of the irradiation.

Optionally, the goods to be filled can also be pre-purified or disinfected in advance by processes known per se and subsequently treated using the sterilization or disinfection method according to the invention. In principle, all types of goods to be filled can be disinfected or sterilized using the process according to the invention, for example individually packaged goods, goods to be filled, powders, grains, liquids and water, for example bottled. All products which require disinfection and sterile storage, for example foodstuffs, other perishable goods, medicinal products such as disposable syringes, dressing material or implants are possible as products. The method according to the invention utilizes all advantages of the UV sterilization or UV disinfection known per se and avoids recontamination of the products on the way from disinfection to packaging or until they are used as intended since the packaging reliably protects against said recontamination after disinfection. This disinfection system is therefore extraordinarily effective and simple to use. The product properties are not affected and residues, side effects or side products are not produced. The method leads in a single process step to a sterilely packaged good, which ensures quality preservation and suitability for storage in a very simple manner.

The packaging according to the invention is generally not provided with an imprint or any other application that might interfere with the passage of UV irradiation. Small-area imprints, such as for example data or bar codes, that do not cover the product in an interfering manner are of course possible. Optionally, after disinfection the sterile packaging with its content can be provided with an additional outer packaging or labels, which then on their part have decorative or informative elements, for example wrap-around labels, adhesive labels, a print covering the whole surface or part of it, or a metal layer for protection against gas or steam transmissions or the action of light. This outer packaging does not have to meet any special requirements with regard to sterility and therefore can be selected, depending on the application, from the variety of packaging materials known per se based on functionality or visual appearance.

For the characterization of the raw materials and films, the following measured values were used:

Below, the invention is explained by means of exemplary embodiments

Example 1

A transparent three-layered PLA film having a thickness of about 30 μm was produced by extrusion and subsequent stepwise orientation in the longitudinal direction and transverse direction. The base layer consisted to nearly 100% by weight of a polylactic acid having a melting point of about 160° C. The layer additionally comprised stabilizers and neutralizing agents in customary quantities. The two sealable covering layers were essentially composed of an amorphous polylactic acid, this polylactic acid having an L/D ratio of about 40/60. Each of the covering layers comprised in addition 0.1% by weight of $SiO_2$-based particles as antiblocking agent. Each of the covering layers had a thickness of 2.5 μm.

The production conditions in the individual process steps were:

| | | |
|---|---|---|
| extrusion: | temperatures: | 170-200° C. |
| | temperature of the take-off roller: | 60° C. |
| longitudinal stretching: | temperature: | 68° C. |
| | longitudinal stretch ratio: | 2.0 |
| transverse stretching: | temperature: | 88° C. |
| | transverse stretch ratio (effective): | 5.5 |
| setting: | temperature: | 75° C. |
| | convergence: | 5% |

A bag packaging was made from the film. The bag packaging was filled with strawberries and sealed. Subsequently, the filled packaging closed by sealed seams was placed for 30 sec under a low-pressure mercury lamp and subsequently stored at a temperature of about 10° C. for 7 days.

Example 2

A bag packaging was made from the film according to Example 1. The bag packaging was filled with strawberries and sealed. The packaging was stored at a temperature of about 10° C. for 7 days without prior UV disinfection.

Example 3

A transparent three-layered polypropylene film having a symmetrical structure and a total thickness of 20 μm was produced by coextrusion and subsequent stepwise orientation in the longitudinal and transverse direction. Each of the covering layers had a thickness of 0.6 μm. The base layer consisted of a propylene homopolymer having a melting point of 166° C. and a melt flow index of 3.4 g/10 min and N,N-bis-ethoxyalkylamine as antistatic agent. The covering layers consisted of random ethylene-propylene copolymers having a $C_2$ content of 4.5% by weight and 0.33% by weight of $SiO_2$ as antiblocking agent having an average particle size of 2 μm and 0.90% by weight of polydimethylsiloxane.

The production conditions in the individual process steps were:

| | | |
|---|---|---|
| extrusion: | temperatures base layer: | 260° C. |
| | covering layers: | 240° C. |
| | temperature of the take-off roller: | 20° C. |
| longitudinal stretching: | temperature: | 110° C. |
| | longitudinal stretch ratio: | 5.5 |
| transverse stretching: | temperature: | 160° C. |
| | transverse stretch ratio: | 9 |
| setting: | temperature: | 140° C. |
| | convergence: | 20% |

A bag packaging was made from the film. The bag packaging was filled with strawberries and sealed. Subsequently, the filled packaging closed by sealed seams was placed for 30 sec under a low-pressure mercury lamp and stored at a temperature of about 10° C. for 7 days.

As a result, the strawberries that had been packaged and UV disinfected according to Example 1 did not show any signs of putrefaction or mold infestation, whereas without UV disinfection (Example 2) or with oPP film despite UV disinfection (Example 3) signs of spoilage were easily detectable.

The invention claimed is:

1. A method for disinfection, partial disinfection or sterilization of a product which comprises enclosing the product with a UVC permeable packaging material made of polyhydroxycarboxylic acid and subsequently disinfecting, partially disinfecting or sterilizing in the packaged state by means of irradiation with UVC radiation.

2. The method according to claim 1, wherein the packaging material is a film.

3. The method according to claim 2, wherein the film comprises 80 to <98% by weight of a polymer made of aliphatic polyhydroxycarboxylic acid.

4. The method according to claim 3, wherein the film has covering layers on both sides and the covering layers comprise 70 to <100% by weight of a polymer made of aliphatic polyhydroxycarboxylic acid.

5. The method according to claim 4, wherein at least one covering layer is sealable.

6. The method according to claim 3, wherein the aliphatic polyhydroxycarboxylic acid is a polylactic acid.

7. The method according to claim 2, wherein the film has a total thickness of at least 20 to 100 μm.

8. The method according to claim 1, wherein the packaging material is a container.

9. The method according to claim 1, wherein the packaging material is a combination of a bowl with a lid or lidding film.

10. The method according to claim 1, wherein the packaging material is a bottle.

11. The method according to claim 1, wherein UV irradiation occurs by means of a mercury lamp.

12. The method according to claim 1, wherein the product is foodstuff or a food product.

13. The method according to claim 1, wherein the product is a medicinal product.

14. The method according to claim 1, wherein the product is a tampon.

15. The method according to claim 1, wherein the product is a cosmetic product.

16. The method according to claim 1, wherein the product is a liquid product.

17. The method according to claim 1, wherein the product is water.

18. The method according to claim 1, wherein the packaging is provided with a further outer packaging.

19. The method according to claim 1, wherein the packaging is provided with a label.

* * * * *